US006029463A

United States Patent [19]

Stenvinkel

[11] Patent Number: 6,029,463

[45] Date of Patent: Feb. 29, 2000

[54] METHOD AND APPARATUS FOR COOLING OR CONDENSING MEDIUMS

[75] Inventor: Bengt Stenvinkel, Kalmar, Sweden

[73] Assignee: Thermoprodukter AB, Kalmar, Sweden

[21] Appl. No.: 09/091,515

[22] PCT Filed: Dec. 20, 1996

[86] PCT No.: PCT/SE96/01729

§ 371 Date: Jun. 19, 1998

§ 102(e) Date: Jun. 19, 1998

[87] PCT Pub. No.: WO97/23384

PCT Pub. Date: Jul. 3, 1997

[30] Foreign Application Priority Data

Dec. 22, 1995 [SE] Sweden ..... 9504637

[51] Int. Cl.[7] ..... B63B 25/26

[52] U.S. Cl. ..... 62/115; 62/240; 62/506; 165/44; 440/88

[58] Field of Search ..... 62/115, 240, 506; 165/41, 44, 154, 156; 440/88

[56] References Cited

U.S. PATENT DOCUMENTS

| | | | |
|---|---|---|---|
| 2,682,852 | 7/1954 | Ruffolo | 165/44 |
| 3,540,229 | 11/1970 | Bunten | 62/240 |
| 4,355,518 | 10/1982 | Beitner | 62/240 |
| 4,557,319 | 12/1985 | Arnold | 165/44 |
| 5,848,536 | 12/1998 | Dodge et al. | 62/240 |
| 5,890,939 | 4/1999 | Cotton | 440/88 |

FOREIGN PATENT DOCUMENTS 425374 9/1982 Sweden .

*Primary Examiner*—William E. Tapolcai
*Attorney, Agent, or Firm*—Larson & Taylor

[57] ABSTRACT

A method and an apparatus for providing a cooling or a condensing of a hot fluid received from a heat generating apparatus using a cooling apparatus or a condenser. The apparatus includes a hollow cooling or condensing pot (6) having an inner cavity (10) providing an axial through channel in the pot (6). There is at least one cooling sling (12) in the cavity and/or adjacent the walls or inside the walls (13) of the pot (6). The cooling or condensing pot (6) is formed for mounting on a hull lead-through (4) with one end thereof, or as a lead-through of a water craft. This lead-through exteriorly opens underneath the level of the surrounding sea water (3). The second end (2) of the cooling or condensing pot (6) is arranged for being connected to a tube or hose which is open upwardly, for instance a drainage hose (2) of a sink (1) or a similar device. Sea water (3) is thus allowed to freely enter the cavity (10) of the pot and leave same, whereby an intermittent pumping movement into and out of this cavity is obtained when the boat rocks, or when the sea water (3) outside the boat is subjected to a certain wave movement.

14 Claims, 4 Drawing Sheets

METHOD AND APPARATUS FOR COOLING OR CONDENSING MEDIUMS

FIELD OF THE INVENTION

In pleasure water craft, there is normally a shortage of available electric current. In particular in sailing boats, accumulator batteries can be charged only during short periods (a) by means of current from land, or (b) by means of a combustion engine having a battery charging generator which charges the battery(ies) when the engine is running. While using electrical equipment like refrigerators or other cooling apparatus, it is therefore important that the consumption of current is reduced as far as possible for the purpose of saving energy. This is also a problem in motor boats and all types of other water craft.

BACKGROUND OF THE INVENTION

Typically, air cooled condensers have been used for cooling or condensing the cooling medium used in a refrigerator. Such air condensers make use of a fan, which consumes current and which is also somewhat noisy. Further, the air condensers often occupy a large space in the boat. In some cases attempts have been made to make use of the sea water outside the boat hull for creating the necessary low temperature for condensing the cooling medium. This often also increases the efficiency, since the sea water is normally substantially colder than the air inside the boat. However, where this is done, exterior cooling slings are mounted unprotected against mechanical actuation from outside, and they are often subjected to corrosion and fouling. This reduces the cooling effect thereof. It is also unsuitable to drill one or more bores through the hull in order to have the exterior condenser tubes or slings extend through the hull, since there may easily appear leakage therefrom. Further, the condenser slings can easily be damaged by objects appearing in the vicinity thereof, since such slings extend completely unprotected along the exterior side of the hull.

SUMMARY OF THE INVENTION

The basis of the invention is the idea of making use of rocking movements and other movements of the boat in the sea, or the movements of the surrounding sea waves, for providing a cooling apparatus, for instance a condenser, which does not consume any electric current at all. To this end there is used, according to the invention, a type of open outlet which opens underneath the level of the source of water, especially underneath the sea water level outside the boat. For instance, the outlet of a drainage hose of a sink or washing means, or any other similar lead-through means provided through the boat hull and which opens underneath the water level outside the boat hull can be used. In particular, an "open" lead-through (inlet) means of a boat is suitable. In such an outlet tube, there often appears a type of "pumping movement" of water as soon as the boat moves in the water, or when there are wave movements in the water outside the boat. An advantage of such an open outlet is that the outlet hose always provides an open communication between the sea water at the exterior side of the boat hull, underneath the sea water level, and the atmospheric air above the sink. In most cases the boat rocks more or less, and a water column moves up and down in the outlet (drainage) hose inside the boat. The water column in this outlet hose also acts according to the principle of communicating vessels in relation to the water outside the boat hull, whether the raising and lowering of the water column in the outlet hose depends on the fact that the boat rocks or that there are wave movements in the water outside the boat hull.

Now the invention is to be described more in detail with reference to the accompanying drawings, which show a couple of different embodiments of a cooler or condenser, in particular—but not solely—useful for refrigerators, freezing boxes or similar apparatus mounted in water craft. It is obvious to the expert that the coolers or condensers described in the following can be used for cooling of all kinds of hot fluids in water craft.

DESCRIPTION OF THE INVENTION

Figure 1:
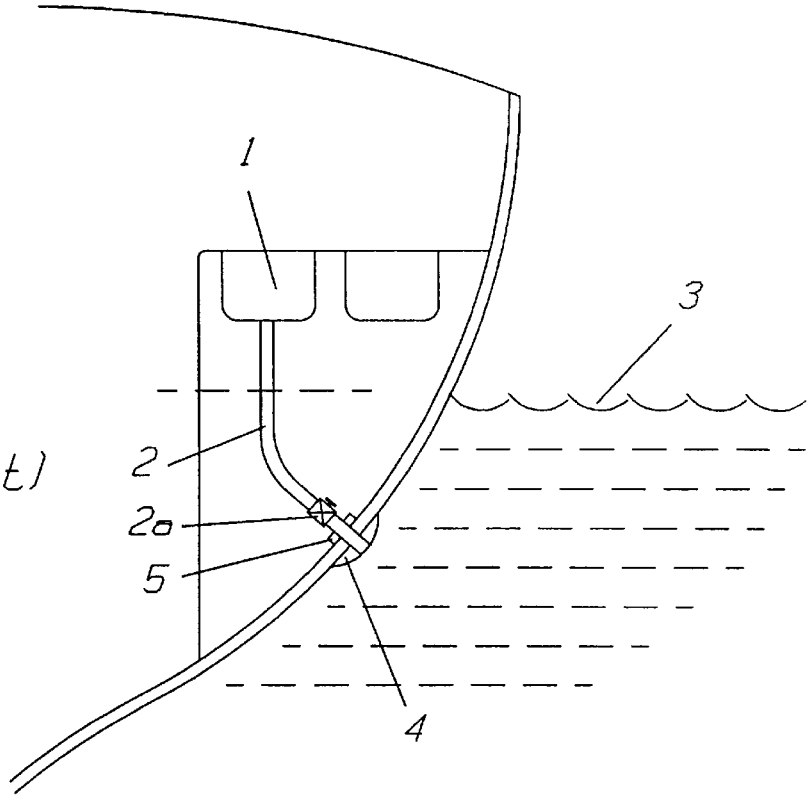
Fig. 1 (Prior Art)
FIG. 1 shows a cross section view through a boat hull according to the prior art having a conventional sink with an outlet extending through the boat hull.

FIG. 1 shows a prior art boat having a sink 1 with a drainage or outlet hose 2 extending through the boat hull. This drainage hose 2, as conventional, has a safety stop-cock 2*a*. The outlet hose 2 opens underneath the level of the sea water 3 outside the boat hull. Thereby, the sink 1 directly communicates with the sea water 3. For providing a seal against the boat hull there is used, according to prior art technics, a hull lead-through 4 which, by means of a nut 5 on the inner side of the hull, provides a sealing. The hose 2 is connected to a socket of the lead-through 4.

Figure 2:
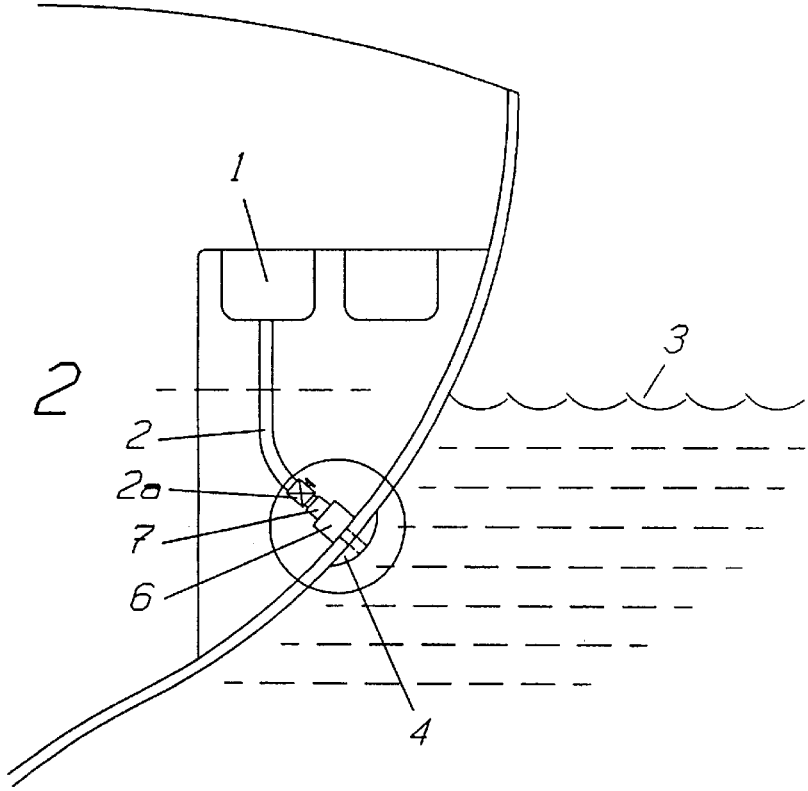
FIG. 2 shows the boat having the invention installed therein.
Figure 3:
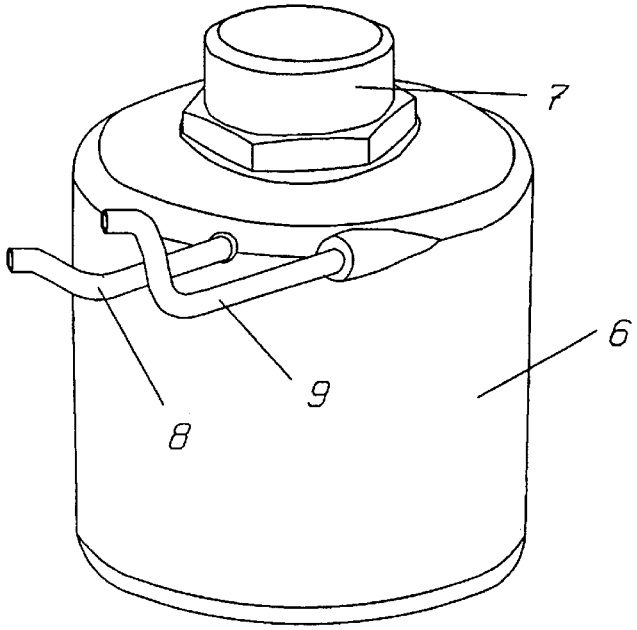
FIG. 3 is a perspective view ling or condensing apparatus according to the invention.

According to the invention, the nut 5 belonging to the lead-through 4 of the prior art apparatus is replaced, as shown in FIG. 2, by a condenser pot 6. The outlet hose 2 with the stop-cock 2*a* is similarly connected to a tube socket 7 at the upper end of the condenser pot 6. As shown in FIG. 3, a tube or conduit 8 contains a hot medium; for instance in the case of a refrigerator or a freezer a gasified cooling medium from a (not shown) refrigeration apparatus, or from another heat generating means in the boat. This hot medium is introduced in the condenser pot 6. A tube 9 containing cooling medium or condensate leads back to the cooling apparatus.

Figure 4:
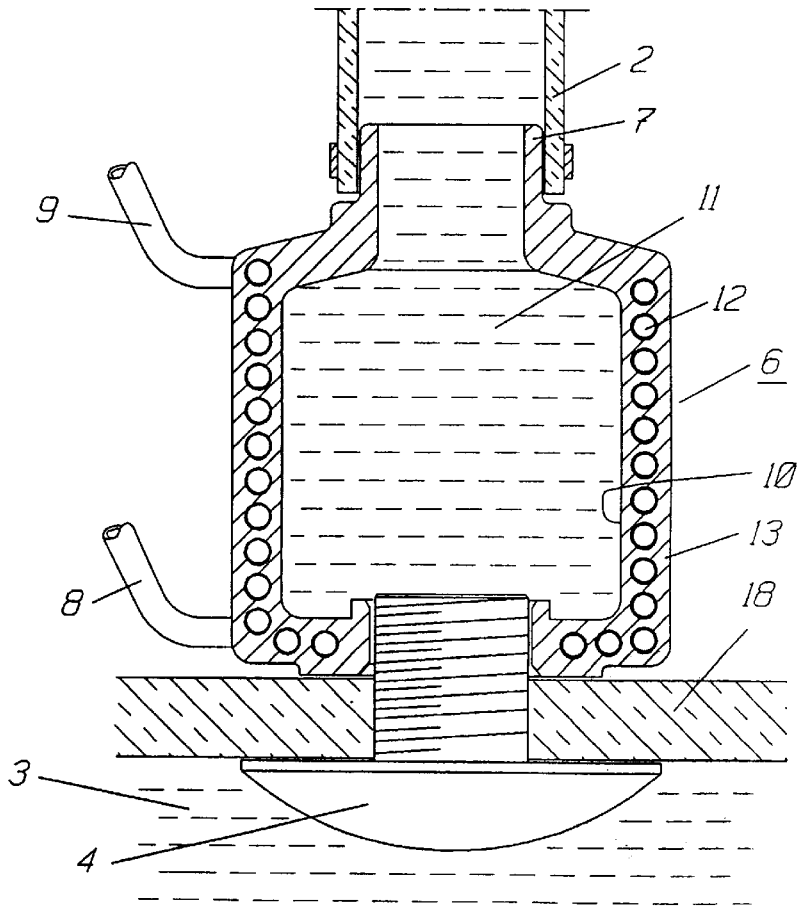
FIG. 4 is a vertical cross section vie through a first embodiment of the cooling or condensing apparatus of FIG. 3.

In the most simple embodiment of the invention, which is shown in an axial cross section view in FIG. 4, the condenser pot 6 is hollow and forms a chamber 10 containing sea water 11. Since the boat practically always rocks somewhat in the water, or since the water outside the boat hull is subjected to wave movement, cold sea water will be reciprocally pumped (a) into the chamber 10 of the cooling pot 6 and some distance up in the hose 2, and (b) out of the cooling pot, respectively. Sea water is thereby intermittently flushed (a)

into the condenser pot 6 and partly into the outlet hose 2, and (b) out of the condenser pot 6, respectively. Thus, cold water at certain movements of the boat or of the sea water is introduced into the condenser pot 6, and heated water at other movements are being flushed out of the condenser pot according to the principle of communicating vessels.

A cooling tube sling 12 is embedded by moulding in the wall material 13 of the condenser pot 6, which material may be metal, plastic or other type of material. Condensate exits through the upper end of the secondary cooling sling 12 and this condensate is returned to the refrigeration apparatus through the tube 9.

Thus, the hot medium is introduced in the cooling pot 6 through the tube 8 at the lower end of the cooling sling 12. Then, the gas, or other hot fluid, is condensated, or is cooled respectively, by the contact with the cold sea water 11 and is returned to the heat creating apparatus (the refrigerator) through the return tube 9 at the upper end of the condenser pot 6. If desired, it is possible to invert the circulation of the cooling medium even if a slightly less cooling effect may be achieved.

Figure 5:
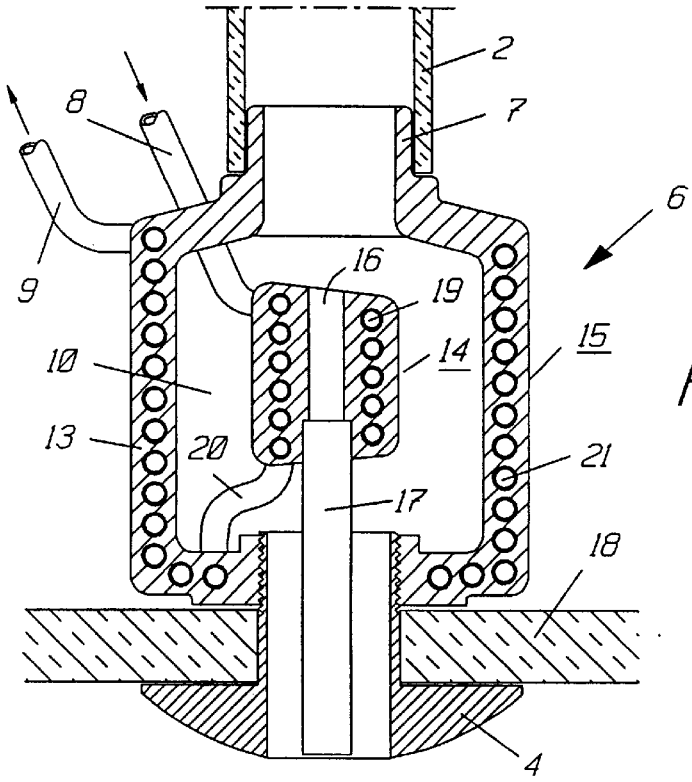
FIG. 5 shows an alternative embodiment of the apparatus according to the invention.

It may sometimes happen that the boat is completely still in the water, and for such circumstances there can be used a condenser pot of the type which is illustrated in FIG. 5. In this case, the condenser pot 6 comprises a primary cooler 14 and a secondary cooler 15. Between the primary and secondary coolers 14, 15, there is an annular space 10. The primary cooler 14 is annular and it has a central through bore 16 which is provided at an inside end of a hose 17. The hose 17 extends through the hull lead-through, and opens in the sea water 3 outside the boat hull 18.

The hot gases leave the refrigerator through the tube 8 and enter the cooling apparatus at the top of the cooling sling 19 of the primary cooler 14. The bottom of the primary cooler 14 is connected, via a tube 20, to the bottom end of a secondary cooling sling 21 of the secondary cooler 15. From the top of secondary cooling sling 21, condensate is returned to the refrigerator through the tube 9.

Figure 6:
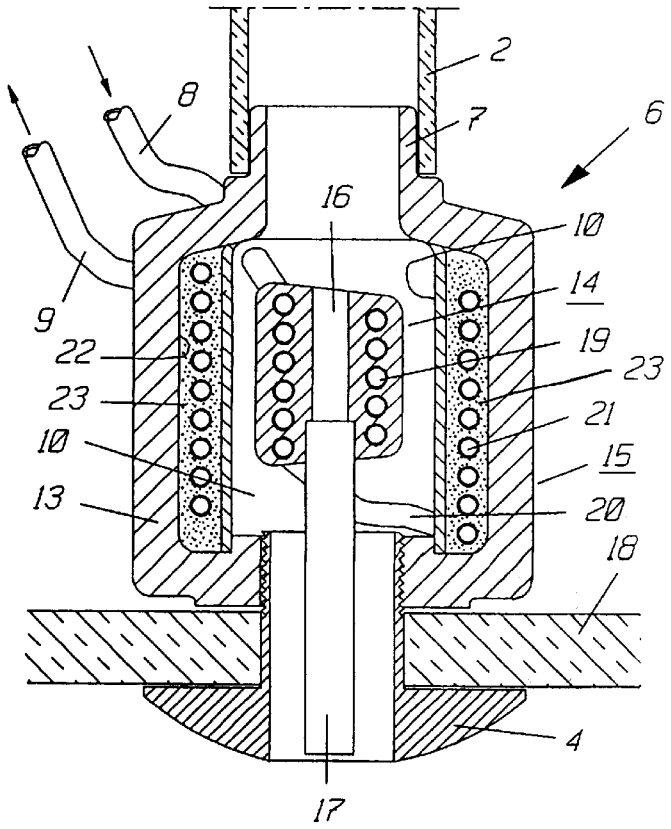
FIG. 6 shows another alternative embodiment of the apparatus according to the invention.

In a third embodiment of the invention, which is shown in FIG. 6, the secondary part 21 of the condenser tube sling is located in a cavity of the "pot" which is a metal moulded pot. In order to make it possible to transfer the heat from the hot primary sling 19 to the metal of the primary cooler 14 and further out into the sea water which is pumped into the cooling pot, and also for equalizing the heat transferring capacity of the apparatus which can depend on varying wave heights of the sea water outside the boat and on varying rocking movements of the boat, a container 22 is mounted in the cavity of the pot and the tubes 21 of the secondary sling are mounted in this container. The container 22 is filled with a eutectic salt 23 having a melting point which is chosen so that the hot condensate, during the operation of the refrigerator, tries to transfer the eutectic salt to melted state—in other words to subject the eutectic salt to a phase inversion (only when the refrigerator operates)—whereas the cold sea water in the cavity 10 of the pot, as far as possible, continuously tries to make the eutectic salt 23 become solidified.

Preferably the eutectic salt 23 is chosen so that the melting point of the salt is located substantially midway of the water temperature, which may be +20° C. to +26° C., and the temperature of the hot medium in the primary cooling sling 19, which temperature may be +40° C. to +45° C. This means that the melting point of the eutectic medium should preferably be about +28° C. to +36° C. This temperature is designed to give an excellent increase and equalization of the effect.

In the embodiment which is shown in FIG. 4, sea water 11 is intermittently pumped into the cavity 10 of the condenser pot 6. The cold sea water cools the fluid in the cooling sling 12, and heated water leaves the condenser pot 6 to the same extent as cold water is pumped into the condenser put 6.

In the embodiment of FIGS. 5 and 6, cold sea water 3 passes through the hose 17 into the bore 16 of the primary cooler 14, in which the sea water is heated, whereby the heated water is transferred up through the outlet hose 2 in a type of siphon action. Parallel thereto, cold sea water is pumped into and out of the cavity 10 of the condenser pot 6 exteriorly of the primary cooler 14. At the same time as the sea water 3 is heated and moves up through the primary cooler, a corresponding amount of water is necessarily forced out of the condenser pot 6 and out through the hull lead-through 4. In this way an auto-circulation is obtained in the primary cooler 14, whereby the primary cooler 14 acts as a thermal pump. Following the condensing of the hot gases in the primary cooler, the cooling medium, which is now in liquid state, (a) sinks to the bottom of the primary cooler 14, (b) moves out of the tube 20, (c) enters the secondary cooler 15 in which the cooling liquid is further cooled down, and (d) is moved back to the refrigerator through the return tube 9.

Figure 7:
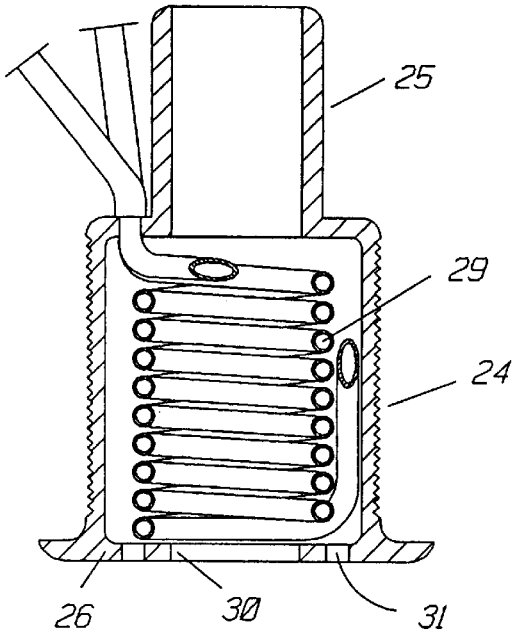
FIG. 7 is an axial cross section view through a still alternative embodiment of the invention.
Figure 8:
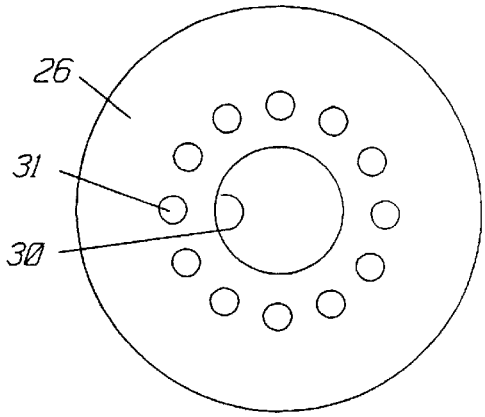
FIG. 8 is a bottom view of the apparatus of FIG. 7.
Figure 9:
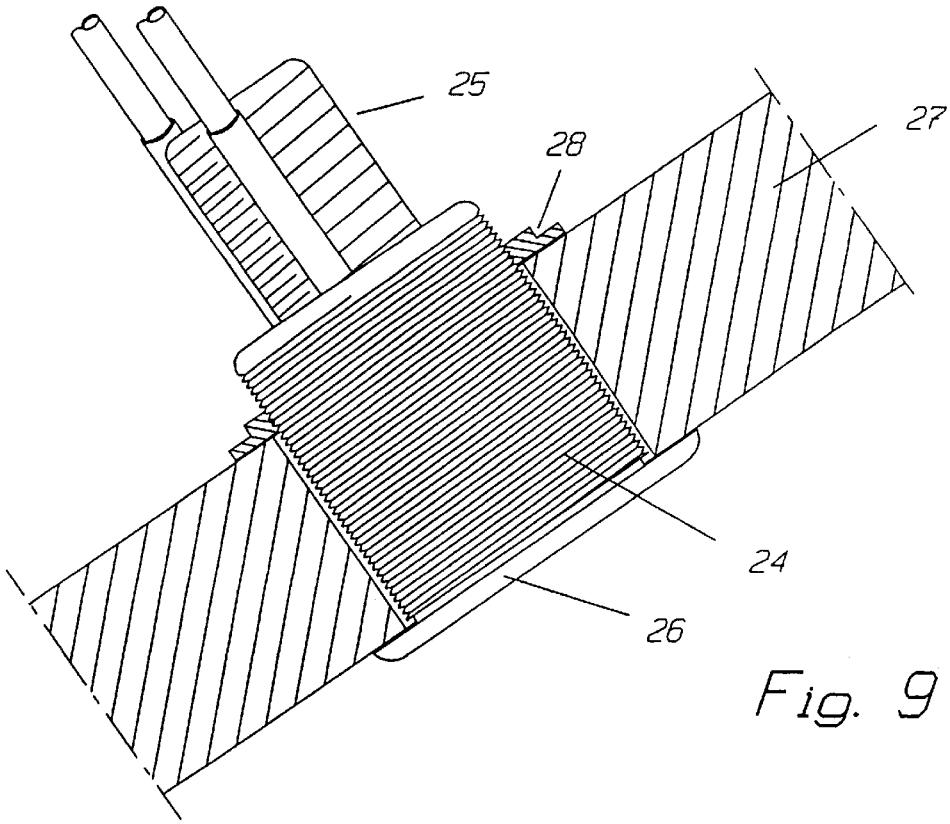
FIG. 9 shows the apparatus of FIG. 7 installed in the hull of a boat.

In order to make sure that the cooling apparatus of the invention is safely connected to the boat hull, the apparatus is preferably formed and mounted as an integral unit directly in the hull. Such an embodiment is shown in FIGS. 7–9. In this case, the condenser pot 6 is formed as an integral unit comprising a cooling part 24, an inner connection part 25 and a bottom part 26 having a projecting bottom flange. The cooling part 24 is threaded and can be mounted directly to the hull 27 by means of a nut 28. The connection part 25 likewise is threaded and can have a stop cock (not shown) directly connected thereto. The condenser pot 6 is formed with a separate cooling sling 29 which is mounted freely inside the condenser pot 6. The bottom part 26 has a central through bore 30 for letting water into and out of the cooling chamber, respectively, and it is also formed with several bores 31 extending in a ring formation round the central through bore 30 for facilitating the sea water to enter and to leave the cooling chamber of the apparatus.

I claim:

1. A method of providing cooling for a fluid circulating through a heat generating apparatus provided on a water craft, said method comprising the steps of:

providing a cooling apparatus which includes (a) a hollow cooling pot having an inner cavity as well as first and second ends which provide an axial flow channel through the inner cavity and (b) a cooling sling in heat transfer communication with the inner cavity of the cooling pot and through which the fluid also circulates;

mounting the first end of the inner cavity of the cooling pot to a hull lead-through of the water craft, which hull lead-through opens underneath a water level of water surrounding the water craft;

connecting the second end of the inner cavity to a drainage hose of a device provided on the water craft for connection to the lead-through and extending upwardly to the device, so that the drainage hose, cooling apparatus and lead-through accommodate a movement of water from the surrounding water therethrough; and allowing water from the surrounding water to freely enter and leave the inner cavity intermittently due to the water craft being subject to one of (a) rocking of the surrounding water or (b) wave movement of the surrounding water while also running the heat generating apparatus, whereby the heated fluid emanating from the heat generating apparatus is circulated through the cooling sling and cooled by the water intermittently entering and leaving the inner cavity of the cooling apparatus.

2. A method of providing cooling for a fluid as claimed in claim 1:

wherein said providing of a cooling apparatus step further includes the steps of a) providing a primary cooler having an axial outside wall, a primary cooling sling in the axial outside wall, and a second axial flow channel inside of the axial outside wall having first and second ends, b) mounting the primary cooler inside the inner cavity of the cooling pot so that the first end of the second axial flow channel opens into the inner cavity of the cooling pot, c) providing a secondary cooler having a secondary cooling sling in heat transfer communication with a wall of the inner cavity of the cooling pot, and d) connecting of the primary and secondary cooling slings to the heat generating apparatus so that the fluid flows therethrough;

wherein said mounting step includes the step of connecting the second end of the second axial flow channel directly with the surrounding water through the hull lead-through; and wherein said allowing step allows water directly from the surrounding water to pass through both the first-mentioned axial flow channel and thus flow around the primary cooler and the second axial flow channel.

3. A method of providing cooling for a fluid as claimed in claim 2, wherein said connecting of the primary and secondary cooling slings step further includes the steps of:

connecting the primary cooling sling to the heat generating apparatus so that the fluid in initially cooled in the primary cooling sling, and connecting of the secondary cooling sling to the primary cooling sling in series so that the fluid cooled in the primary cooling sling is further cooled in the secondary cooling sling.

4. A system for providing cooling of a fluid circulating through a heat generating apparatus provided on a water craft, said system comprising:

a cooling apparatus which includes (a) a hollow cooling pot having an inner cavity as well as first and second ends which provide an axial flow channel through the inner cavity, and (b) a cooler in heat transfer communication with the inner cavity of the cooling pot and through which the fluid also circulates;

a hull lead-through of the water craft which opens underneath a water level of water surrounding the water craft; said first end of the inner cavity of the cooling pot being mounted to said hull lead-through;

a drainage hose of a device provided on the water craft for connection to the lead-through and extending upwardly to the device, said drainage hose being connected to said second end of the inner cavity so that water from the surrounding water freely enters and leaves the inner cavity intermittently due to the water craft being subject to one of (a) rocking of the surrounding water or (b) wave movement of the surrounding water while the heat generating apparatus is running, whereby the heated fluid emanating from the heat generating apparatus is circulated through the cooler and cooled by the water intermittently entering and leaving the inner cavity of the cooling apparatus.

5. A system for providing cooling of a fluid as claimed in claim 4:

wherein said cooler includes a primary cooler, a secondary cooler, and a series connection from said primary cooler to said secondary cooler; and wherein said primary cooler is connected to the heat generating apparatus so that the fluid in initially cooled in said primary cooler.

6. A system for providing cooling of a fluid as claimed in claim 4:

wherein said primary cooler is mounted within said inner cavity of said hollow cooling pot and includes a primary cooling sling connected at an upper end to the heat generating apparatus and which has a lower end; and wherein said secondary cooler includes a secondary cooling sling to which the lower end of the primary cooling sling is connected and from which the cooled fluid is returned to the heat generating apparatus.

7. A system for providing cooling of a fluid as claimed in claim 6:

wherein said primary cooler includes (a) an axial outside wall in which said primary cooling sling is embedded, (b) an axial through bore inside of the axial outside wall, and (c) a tube extending from said axial through bore and through said hull lead-through so that water from the surrounding water passes through both (i) the axial flow channel and thus around the primary cooler and (ii) the second axial flow channel; and wherein said cooling pot includes a wall in which said secondary cooler is embedded.

8. A system for providing cooling of a fluid as claimed in claim 5, wherein said secondary cooler includes:

a container mounted in said inner cavity of said cooling pot, a tube sling mounted in said container, and a eutectic salt which fills said container about said tube sling.

9. A system for providing cooling of a fluid as claimed in claim 8, wherein said eutectic salt has a melting point chosen between 20° C. and 45° C.

10. A system for providing cooling of a fluid as claimed in claim 9, wherein said eutectic salt has a melting point chosen between 28° C. and 36° C.

11. A system for providing cooling of a fluid as claimed in claim 7, wherein said secondary cooler includes:

a space in said wall of said cooling pot in which said secondary cooling sling is located, and a eutectic salt which fills said space about said secondary tube sling.

12. A system for providing cooling of a fluid as claimed in claim 11, wherein said eutectic salt has a melting point chosen between 20° C. and 45° C.

13. A system for providing cooling of a fluid as claimed in claim 12, wherein said eutectic salt has a melting point chosen between 28° C. and 36° C.

14. A system for providing cooling of a fluid as claimed in claim 4;

wherein said hull lead-through includes a main body and a threaded locking member; and wherein cooling pot includes a flanged bottom part and external threads which from said main body of said hull lead-through.

* * * * *